US009192801B1

(12) United States Patent
Gouloubev

(10) Patent No.: US 9,192,801 B1
(45) Date of Patent: Nov. 24, 2015

(54) EXERCISE SUPPORT SYSTEM

(76) Inventor: Vassili Gouloubev, Gulfport, FL (US)

( * ) Notice: Subject to any disclaimer, the term of this patent is extended or adjusted under 35 U.S.C. 154(b) by 786 days.

(21) Appl. No.: 12/653,066

(22) Filed: Dec. 8, 2009

(51) Int. Cl.
*A63B 26/00* (2006.01)
*A63B 21/00* (2006.01)

(52) U.S. Cl.
CPC ..... *A63B 21/00047* (2013.01)

(58) Field of Classification Search
CPC ..... A63B 23/0211
USPC ..... 482/140, 142, 23, 148, 139, 907, 91; 5/630, 640, 740, 716, 718–719, 654, 5/731; 446/220; 606/240; 128/845
See application file for complete search history.

(56) References Cited

U.S. PATENT DOCUMENTS 3,003,815 A * 10/1961 Zinn ..... 297/118
3,742,526 A * 7/1973 Lillard ..... 5/12.1
3,965,507 A * 6/1976 Reiland ..... 482/18
4,207,635 A * 6/1980 Leroy ..... 5/656
4,210,322 A * 7/1980 Pritchard ..... 482/23
4,215,857 A * 8/1980 Gordon ..... 482/15
D267,028 S * 11/1982 Spisak ..... D21/686
D284,394 S * 6/1986 Bengtson et al. ..... D21/676
4,597,386 A * 7/1986 Goldstein ..... 602/19
4,796,315 A * 1/1989 Crew ..... 5/630
4,923,187 A * 5/1990 Mombrinie ..... 5/648
4,970,742 A * 11/1990 Keener ..... 5/633
5,060,638 A * 10/1991 Bodine, Jr. ..... 602/21
5,088,141 A * 2/1992 Meyer et al. ..... 5/636
5,180,386 A * 1/1993 Kennedy, Jr. ..... 606/240
5,304,109 A * 4/1994 Shockley ..... 482/142
5,432,967 A * 7/1995 Raftery ..... 5/633
RE35,083 E * 11/1995 Roosevelt ..... 482/104
5,474,513 A * 12/1995 Carlesimo et al. ..... 482/140
5,584,786 A * 12/1996 Almeda ..... 482/142
5,611,765 A * 3/1997 Koch, Jr. ..... 482/142
5,755,647 A * 5/1998 Watnik ..... 482/121
5,795,276 A * 8/1998 Almeda ..... 482/142
5,797,154 A * 8/1998 Contreras ..... 5/636
D406,718 S * 3/1999 Jacobs ..... D6/601
6,270,155 B1 * 8/2001 Rashid ..... 297/1
6,381,784 B1 * 5/2002 Davis et al. ..... 5/636
D469,486 S * 1/2003 Olson ..... D21/687
6,623,270 B1 * 9/2003 Meldeau ..... 432/140
6,679,817 B1 * 1/2004 Williams ..... 482/140
6,689,028 B2 * 2/2004 Smith ..... 482/148
6,823,545 B1 * 11/2004 Davis ..... 5/630
6,921,372 B2 * 7/2005 Shin ..... 601/134
D509,269 S * 9/2005 Decker ..... D21/686
6,955,635 B2 * 10/2005 Chelekis ..... 482/140
7,033,307 B2 * 4/2006 Van Straaten ..... 482/142
7,044,901 B2 * 5/2006 Weir ..... 482/142

(Continued)

*Primary Examiner* — Lori Baker

(57) ABSTRACT

A pillow has a lower surface with forward and rearward edges spaced by a length of about 9 inches coupled by perpendicular lateral side edges spaced by a width and an arcuate upper surface with a forward section formed with a radius of curvature of about 5 inches and a rearward section formed with a radius of curvature of about 15 inches. The pillow has a maximum height between the upper and lower surfaces of about 2.5 inches. The upper surface has a high point closer to the forward edge than the rearward edge. Between 40 and 45 percent of the length of the pillow is forward of the high point and 55 and 60 percent of the length of the pillow is rearward of the high point. Similarly configured planar side surfaces of the pillow have a curved upper edge and a lower edge co-extensive with the side edges of the lower surface. The method of exercising uses the pillow as a fulcrum to support a user while lifting one portion of the user's body.

1 Claim, 4 Drawing Sheets

(56) References Cited

U.S. PATENT DOCUMENTS

| | | | | |
|---|---|---|---|---|
| D523,913 | S * | 6/2006 | Van Straaten | D21/686 |
| 7,063,677 | B1 * | 6/2006 | Daggett | 602/13 |
| D526,033 | S * | 8/2006 | Van Straaten et al. | D21/688 |
| 7,134,988 | B2 * | 11/2006 | Van Straaten et al. | 482/142 |
| 7,169,099 | B1 * | 1/2007 | Kemery et al. | 482/146 |
| 7,203,983 | B1 * | 4/2007 | Reeves et al. | 5/636 |
| 7,213,280 | B2 * | 5/2007 | Lavin et al. | 5/636 |
| D555,741 | S * | 11/2007 | Wachtfogel et al. | D21/686 |
| D571,871 | S * | 6/2008 | Backstrand et al. | D21/686 |
| 7,452,313 | B2 * | 11/2008 | Endelman | 482/140 |
| 7,563,217 | B2 * | 7/2009 | Endelman | 482/142 |
| 7,691,042 | B2 * | 4/2010 | Pandozy | 482/142 |
| 2002/0098958 | A1 * | 7/2002 | Watnik | 482/140 |
| 2003/0207738 | A1 * | 11/2003 | Wong | 482/74 |
| 2004/0211004 | A1 * | 10/2004 | Thompson | 5/655.3 |
| 2005/0124468 | A1 * | 6/2005 | Wong | 482/52 |
| 2007/0099761 | A1 * | 5/2007 | Edwards | 482/51 |
| 2008/0254956 | A1 * | 10/2008 | Purvis | 482/140 |
| 2010/0000548 | A1 * | 1/2010 | Haworth et al. | 128/845 |
| 2010/0152003 | A1 * | 6/2010 | Haas | 482/95 |
| 2010/0184567 | A1 * | 7/2010 | Lim | 482/23 |
| 2010/0190622 | A1 * | 7/2010 | Johnson | 482/136 |

* cited by examiner

FIG 1
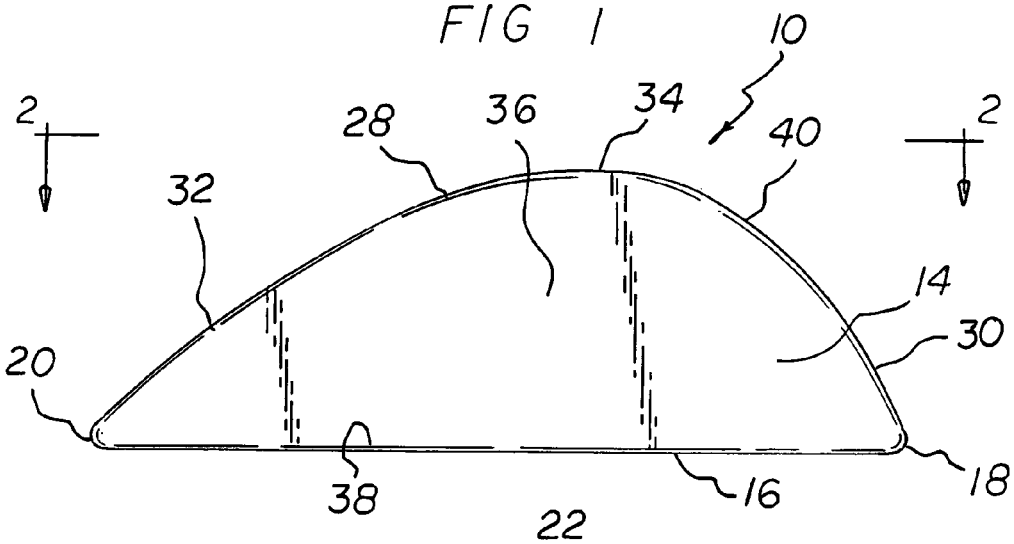
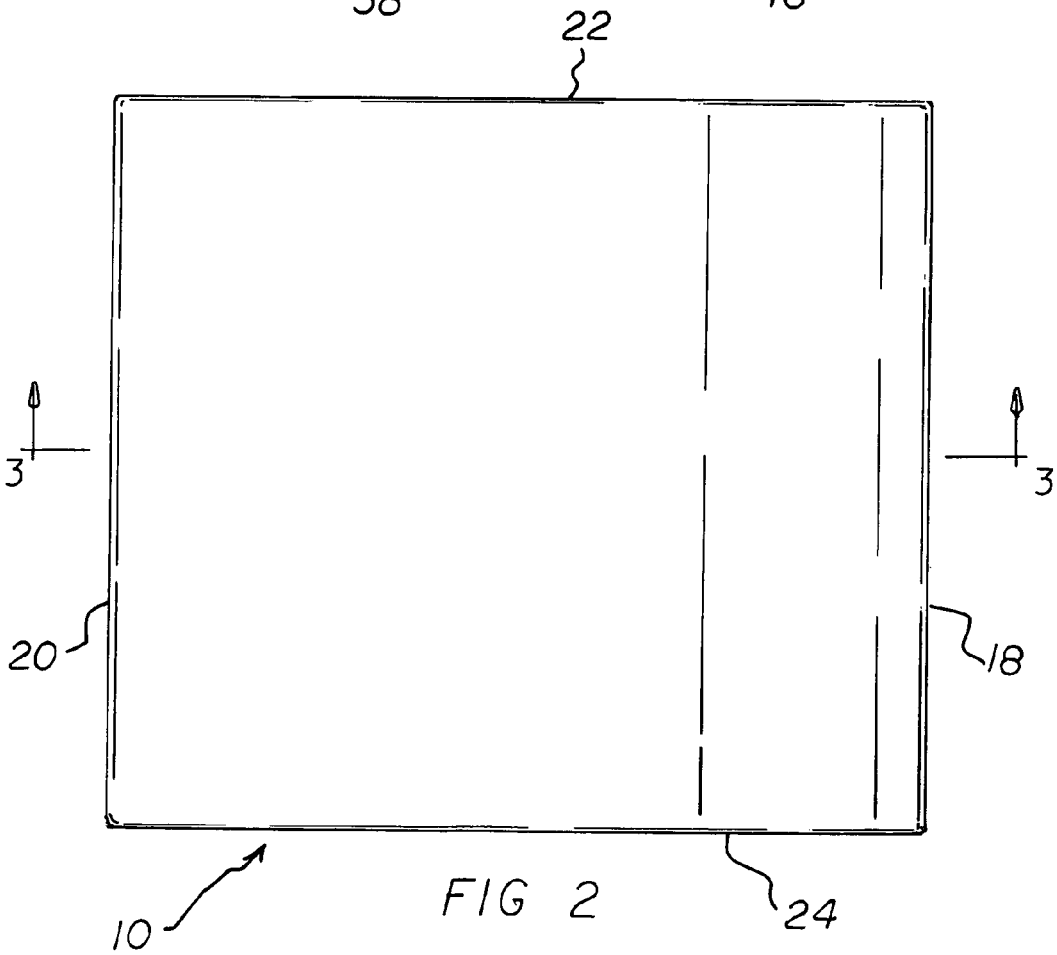
FIG 2

FIG 3
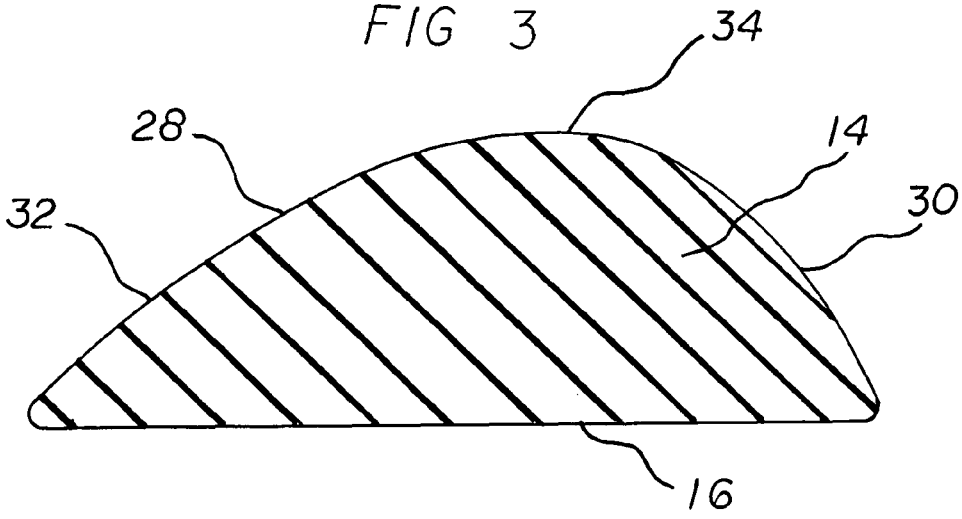
FIG 4
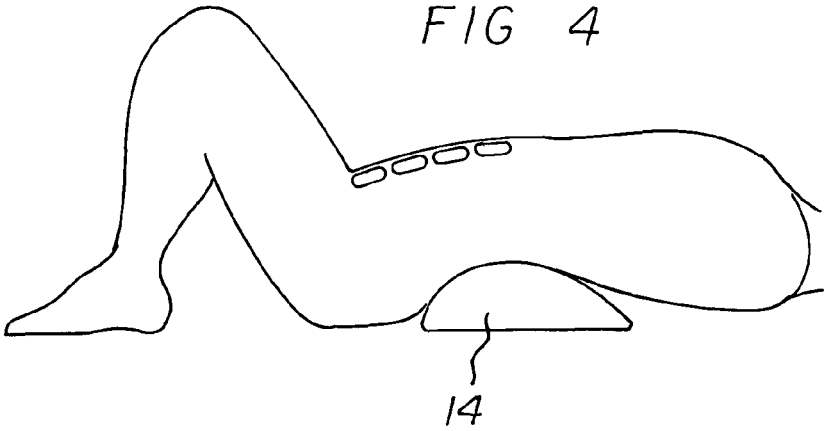
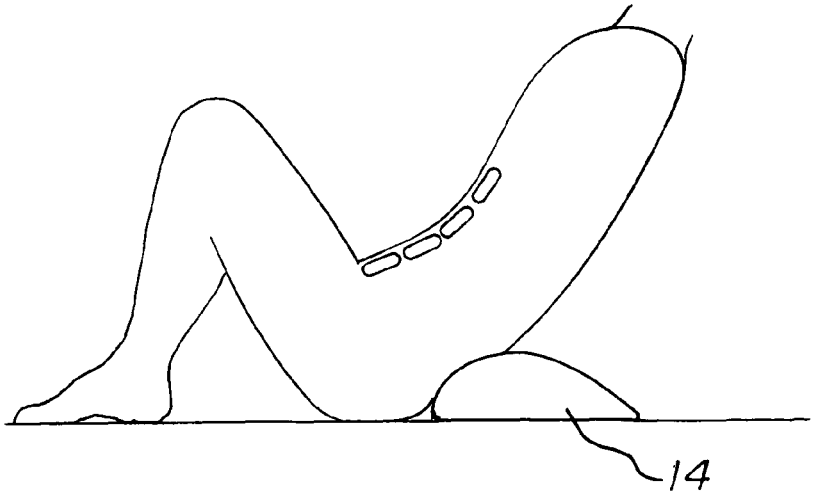
FIG 5

FIG 10
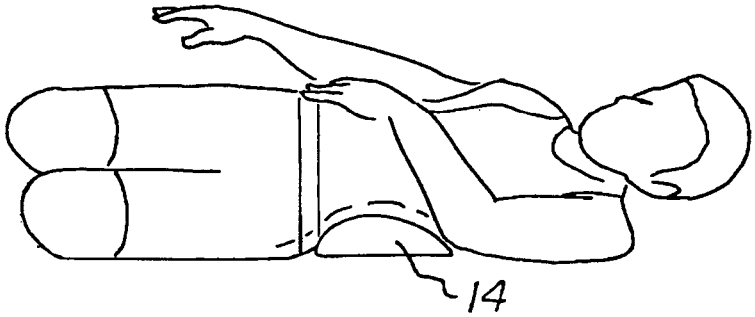
FIG 11
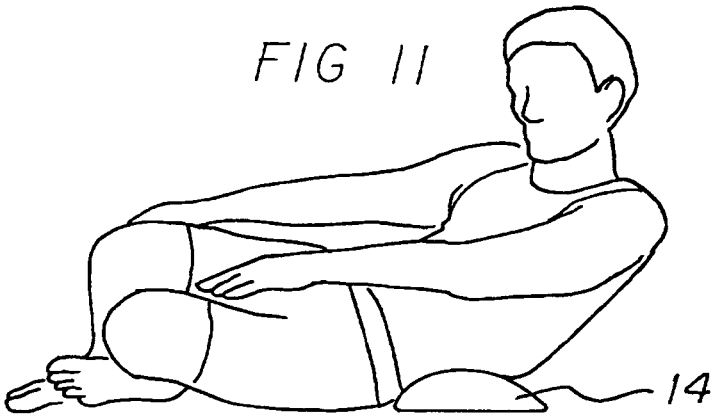
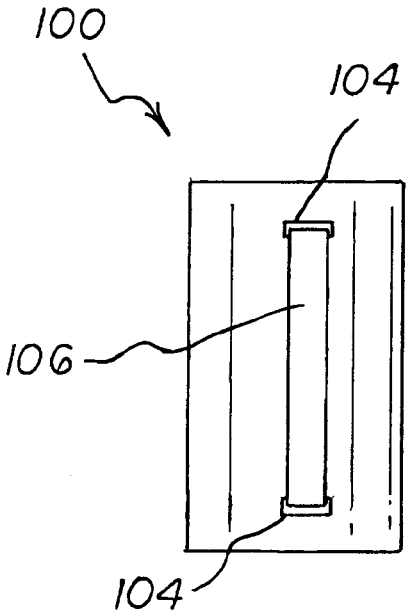
FIG 12
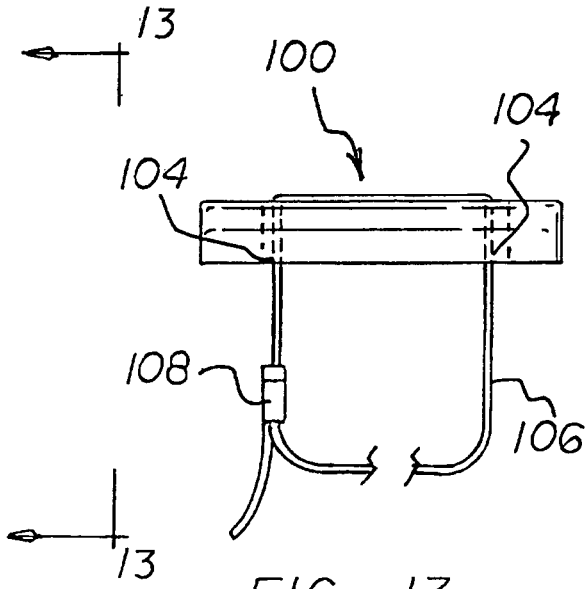
FIG 13

EXERCISE SUPPORT SYSTEM

BACKGROUND OF THE INVENTION

1. Field of the Invention

The present invention relates to an exercise support system and more particularly pertains to providing a fulcrum about which a user's body pivots while bending between a lowered orientation and a raised orientation.

2. Description of the Prior Art

The use of exercise support systems of known designs and configurations is known in the prior art. More specifically, exercise support systems of known designs and configurations previously devised and utilized for the purpose of supporting a user while exercising are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,611,765 issued Mar. 18, 1997 to Koch relates to an Exercise Device. Also, U.S. Pat. No. 5,584,786 issued Dec. 17, 1996 to Almeda relates to An Abdominal Exercise Device. While these devices fulfill their respective, particular objectives and requirements, the aforementioned patents do not describe an exercise support system that allows providing a fulcrum about which a user's body pivots while bending between a lowered orientation and a raised orientation.

In this respect, the exercise support system according to the present invention substantially departs from the conventional concepts and designs of the prior art, and in doing so provides an apparatus of a preferred size and shape and resilience about which a user's body pivots while bending between a lowered orientation and a raised orientation.

Therefore, it can be appreciated that there exists a continuing need for a new and improved exercise support system about which a user's body moves while bending between a lowered orientation and a raised orientation. In this regard, the present invention substantially fulfills this need.

SUMMARY OF THE INVENTION

In view of the disadvantages inherent in the known types of exercise support systems of known designs and configurations now present in the prior art, the present invention provides an improved exercise support system. As such, the general purpose of the present invention, which will be described subsequently in greater detail, is to provide a new and improved exercise support system and method which has all the advantages of the prior art and none of the disadvantages.

To attain this, the present invention essentially comprises a one piece pillow with a rectangular lower surface with a linear forward edge and a parallel rearward edge. The forward edge and rearward edge are spaced by a length of 9 inches, plus or minus 10 percent. The lower surface has lateral side edges perpendicular to and coupling the forward and rearward edges. The side edges are spaced by a width of 12 to 16 inches, plus or minus 10 percent. The lower surface is positionable horizontally upon a recipient surface during use.

The pillow has an arcuate upper surface. The upper surface has a forward section formed with a radius of curvature of 5 inches, plus or minus 10 percent, over the majority of its extent. The upper surface has a rearward section formed with a radius of curvature of 15 inches, plus or minus 10 percent, over the majority of its extent. The pillow has a height between the upper and lower surfaces with the maximum height being 2.5 inches, plus or minus 10 percent. The upper surface has a high point located closer to the forward edge than the rearward edge with between 40 and 45 percent of the length of the pillow being forward of the high point and 55 and 60 percent of the length of the pillow being rearward of the high point.

The pillow has similarly configured parallel side surfaces. Each side surface is planar and has a linear lower edge coextensive with one of the side edges of the lower surface. Each side surface has a curved upper edge.

The pillow is fabricated of closed cell ethylene vinyl acetate foam with a hardness of 14+/−3, Asker C, a density of 2.2+/−0.2 p.s.f. and with a limited resilience. In this manner, the high point is depressed by between 15 and 20 percent of its height when a user weighing between 120 and 180 pounds lies upon the pillow. The pillow is adapted to support a user with the high point beneath a lower extent of the user's spine, beneath any of a plurality of intermediate extents of the user's spine, beneath an upper extent of the user's spine, and beneath a side and stomach of the user.

A method of exercising using the support system of a preferred size, shape and resilience to function as a fulcrum about which the user's body may pivot while bending between a lowered orientation and a raised orientation is included in the present invention.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved exercise support system which has all of the advantages of the prior art exercise support systems of known designs and configurations and none of the disadvantages.

It is another object of the present invention to provide a new and improved exercise support system which may be easily and efficiently manufactured and marketed.

It is further object of the present invention to provide a new and improved exercise support system which is of durable and reliable constructions.

An even further object of the present invention is to provide a new and improved exercise support system which is susceptible of a low cost of manufacture with regard to both materials and labor, and which accordingly is then susceptible of low prices of sale to the consuming public, thereby making such exercise support system economically available to the buying public.

Even still another object of the present invention is to provide an exercise support system for providing a fulcrum about which a user's body pivots while bending between a lowered orientation and a raised orientation.

Lastly, it is an object of the present invention to provide a new and improved exercise support system having pillow with a lower surface with forward and rearward edges spaced by a length of about 9 inches coupled by perpendicular lateral side edges spaced by a width of about 12 to 16 inches and an arcuate upper surface with a forward section formed with a radius of curvature of about 5 inches and a rearward section formed with a radius of curvature of about 15 inches. The pillow has a maximum height between the upper and lower surfaces of about 2.5 inches. The upper surface has a high point closer to the forward edge than the rearward edge. Between 40 and 45 percent of the length of the pillow is forward of the high point and 55 and 60 percent of the length of the pillow is rearward of the high point. Similarly configured planar side surfaces of the pillow have a curved upper edge and a lower edge co-extensive with the side edges of the lower surface. The method of exercising uses the pillow as a fulcrum to support a user while lifting one portion of the user's body.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated the preferred and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an exercise support system constructed in accordance with the principles of the present invention.

FIG. 2 is a plan view of the system taken along line 2-2 of FIG. 1.

FIG. 3 is a cross sectional view of the system taken along line 3-3 of FIG. 2.

FIGS. 4 and 5 illustrate the system in use with a user's body lowered and raised and with the system at a rearward location.

FIGS. 10 and 11 illustrate the system in use with a user's body lowered and raised while performing side lifts.

FIG. 12 is a plan view of an alternate embodiment of the invention.

FIG. 13 is a side elevational view taken along line 13-13 of FIG. 12.

The same reference numerals refer to the same parts throughout the various Figures of the various alternate embodiments of the invention.

DESCRIPTION OF THE PREFERRED EMBODIMENT

Figure 6:
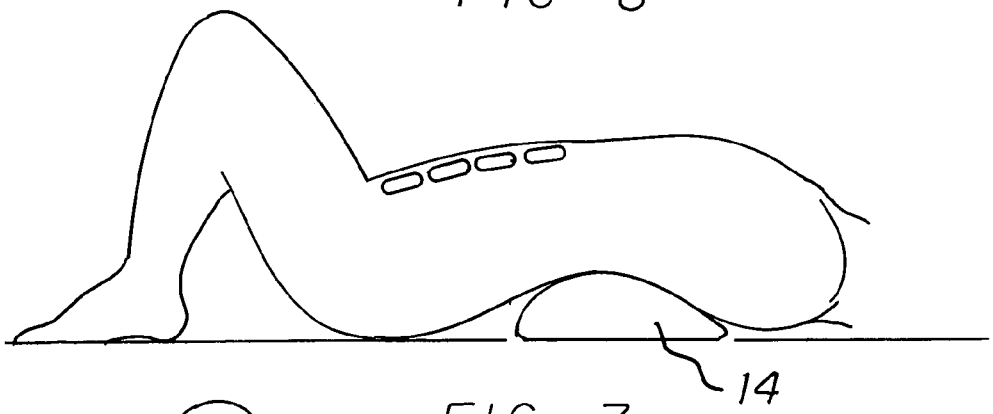
FIGS. 6 and 7 illustrate the system in use with a user's body lowered and raised but with the system at an intermediate location.

With reference now to the drawings, and in particular to FIG. 1 thereof, the preferred embodiment of the new and improved exercise support system embodying the principles and concepts of the present invention and generally designated by the reference numeral 10 will be described.

The present invention, the exercise support system 10 is comprised of a plurality of components. Such components in their broadest context include a pillow with a lower surface and arcuate upper surface and similarly configured planar side surfaces. Such components are individually configured and correlated with respect to each other so as to attain the desired objective.

The exercise support system 10 of the present invention is for providing a fulcrum about which a user's body may pivot while bending between a lowered orientation and a raised orientation. First provided is a one piece pillow 14. The pillow has a rectangular lower surface 16 with a linear forward edge 18 and a parallel rearward edge 20. The forward edge and rearward edge are spaced by a length of 9 inches, plus or minus 10 percent. The lower surface has lateral side edges 22, 24 perpendicular to and coupling the forward and rearward edges. The side edges are spaced by a width of 12 to 16 inches, plus or minus 10 percent. The lower surface is positionable horizontally upon a recipient surface during use.

The pillow has an arcuate upper surface 28. The upper surface has a forward section 30 formed with a radius of curvature of 5 inches, plus or minus 10 percent, over the majority of its extent. The upper surface has a rearward section 32 formed with a radius of curvature of 15 inches, plus or minus 10 percent, over the majority of its extent. The pillow has a height between the upper and lower surfaces with the maximum height being 2.5 inches, plus or minus 10 percent. The upper surface has a high point 34 located closer to the forward edge than the rearward edge with between 40 and 45 percent of the length of the pillow being forward of the high point and with between 55 and 60 percent of the length of the pillow being rearward of the high point.

The pillow has similarly configured parallel side surfaces 36. Each side surface is planar and has a linear lower edge 38 co-extensive with one of the side edges of the lower surface. Each side surface has a curved upper edge 40.

Figure 7:
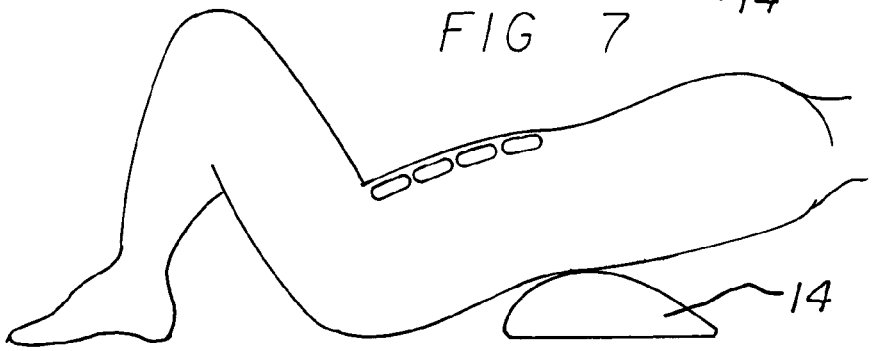
Figure 8:
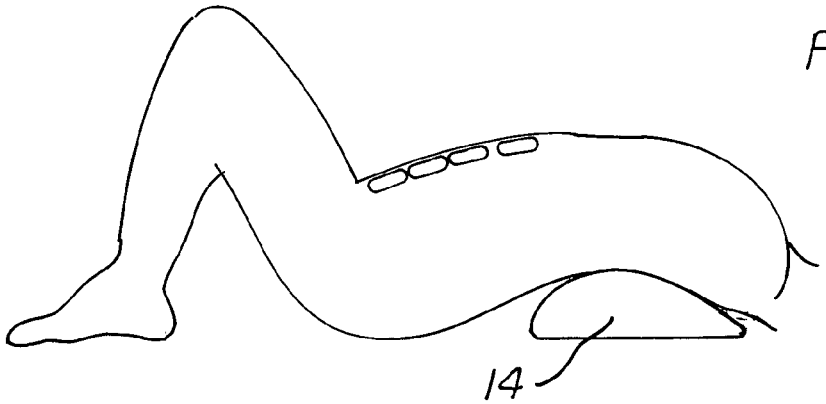
FIGS. 8 and 9 illustrate the system in use with a user's body lowered and raised but with the system at a forward location.
Figure 9:
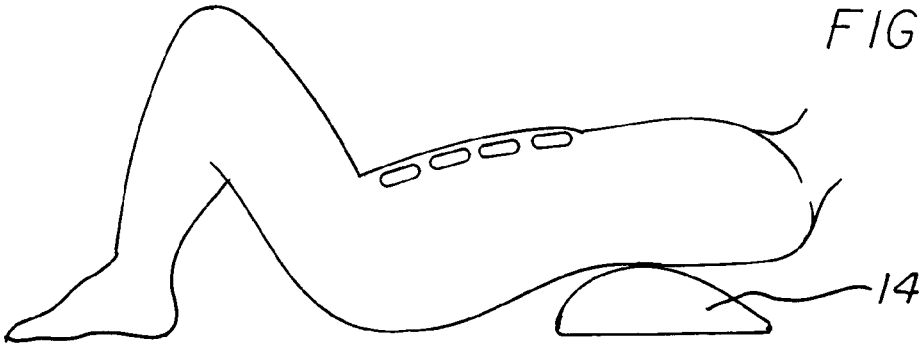

The pillow is fabricated of closed cell ethylene vinyl acetate foam with a hardness 14+/−3, Asker C, a density of 2.2+/−0.2 p.s.f. and with a limited resilience. In this manner, the high point is depressed by between 15 and 20 percent of its height when a user weighing between 120 and 180 pounds lies upon the pillow. The pillow is adapted to support a user with the high point beneath a lower extent of the user's spine. Note FIGS. 4 and 5. The pillow is also adapted to support a user with the high point beneath any of a plurality of intermediate extents of the user's spine. Note FIGS. 6 and 7. The pillow is adapted to support a user with the high point beneath an upper extent of the user's spine. Note FIGS. 8 and 9. The pillow is adapted to support a user with the high point beneath a side or stomach of the user. Note FIGS. 10 and 11.

Reference is now made to the alternate embodiment of the invention as illustrated in FIGS. 12 and 13. In this alternate embodiment, the system 100 further includes two slots 104. Each slot extends through the pillow between the lower surface and the upper surface at the high point of the pillow. Each slot is parallel with and in proximity to an adjacent one of the side surfaces of the pillow. A belt 106 is provided next. The belt is looped through the slots. A buckle 108 is provided. The belt and buckle selectively couple the pillow with respect to a user or to a recipient surface, such as a bench.

The present invention includes a method of exercising with a support system having a fulcrum about which a user's body may pivot while bending between a lowered orientation and a raised orientation.

The first step of the method is providing a one piece pillow 14. The pillow has a rectangular lower surface 16 with a linear forward edge 18 and a parallel rearward edge 20. The forward edge and rearward edge are spaced by a length of 9 inches, plus or minus 10 percent. The lower surface has lateral side edges 22, 24 perpendicular to and coupling the forward and rearward edges. The side edges are spaced by a width of 12 to 16 inches, plus or minus 10 percent. The lower surface is positionable horizontally upon a recipient surface during use. The pillow has an arcuate upper surface 28.

The upper surface has a forward section 32 formed with a radius of curvature of 5 inches, plus or minus 10 percent, over the majority of its extent. The upper surface has a rearward section 32 formed with a radius of curvature of 15 inches, plus or minus 10 percent, over the majority of its extent. The pillow has a height between the upper and lower surfaces with the maximum height being 2.5 inches, plus or minus 10 percent. The upper surface has a high point 34 located closer to the forward edge than the rearward edge with between 40 and 45 percent of the length of the pillow being forward of the high point and with between 55 and 60 percent of the length of the pillow being rearward of the high point.

The pillow has similarly configured parallel side surfaces 36. Each side surface is planar and has a linear lower edge 38 co-extensive with one of the side edges of the lower surface. Each side surface has a curved upper edge 40. The pillow is fabricated of closed cell ethylene vinyl acetate foam with a hardness of 14+/−3, Asker C, a density of 2.2+/−0.2 p.s.f. and with a limited resilience whereby the high point is depressed by between 15 and 20 percent of its height when a user weighing between 120 and 180 pounds lies upon the pillow.

The next step of the method is supporting a user on the pillow.

The final step of the method is using the pillow as a fulcrum while lifting one portion of the user's body.

Alternate methods include supporting the user with the high point of the pillow beneath a lower extent of the user's spine, beneath an intermediate extent of the user's spine, beneath an upper extent of the user's spine, and beneath one side or the stomach of the user.

The present invention is designed in such a way that it fits under a person's back or side or stomach. It serves as a support for muscles when stretching. It also serves as a fulcrum around which the upper or lower part of a person's body is lifted during exercises. It is high enough so as to function as a support of the human back/side/stomach. It can be as high as to fit under a person's back and support it, or as high as to slightly elevate a person's back. The present invention is wide enough so as to be a stable support when a person's body rests on it while using it as a fulcrum during exercise. The device is also narrow enough so it can be positioned in a full range from a person's lower back to a person's upper back. It is positionable under a small area of a person's back and side and stomach so to serve as a rest during muscle stretching and support and as a fulcrum in a full range of positions. It is long enough to comfortably and safely fit under a person's body and serve as a support for the body during exercises.

The top profile is mostly curved. It may have one side more curved that which makes exercises more difficult and suitable for advanced exercises. The other side is less curved which makes exercises easier for beginners. The top surface is curved sufficiently to serve as a fulcrum during exercises and flat enough to be a comfortable support for a person's body.

The present invention has a crown shape at the top to serve as a fulcrum for a person's body rest/rotation. This crown is flat enough to cushion a person's body pressure.

The present invention is made of such material to provide resilience whereby it is hard enough to support a person's body and serve as a rest during stretching. The material has a high point for serving as a fulcrum during exercises. It is also soft enough to be a comfortable support for a human body during exercises.

The present invention may have different shapes and dimensions and be made of any material that can be accommodated to the following purpose: to serve as a support for a person's body while stretching muscles during exercises, to serve as a fulcrum during exercises and be able to be moved in multiple positions along a person's back/side/stomach. This allows abdominal, oblique, back muscles to be exercised in a wide range of positions and in a wide range of angles and degrees of twist of the upper to lower body.

The preferred embodiment of the invention has the following dimensions: width 16 inches, but can be as wide as 10 to 12 inches, a length of 9 inches, and height of 2.5 in. It has one side curve equal to about 3.75 inches along the base, it has the other side curve equal to about 5.25 inches along the base. It compresses about 0.5 inch under a body of 120 to 180 pounds. It is made of closed cell EVA foam of hardness 14+/−3, Asker C, density of 2.2+/−0.2 p.s.f.

The advantages of the present invention are unprecedented precise abdominal area muscle targeting; complete abdominal muscles workout, i.e., all muscles in the area; isolation of targeted muscles for a more effective workout; elimination of common flaws and dangers of regular abdominal exercises; hip flexors are not involved; safety for neck, no strain; no shoulder strain; no over vertebrae disks compression; portability, can be used at home, in a gym, or on a trip; and it fits a shelf in a closet.

The present invention allows targeting small areas of abdominal/oblique muscles at different angles and with different load on muscles.

The present invention is movable and infinitely laterally adjustable. The prior art devices are static. They take only one body position. The present invention is unique because it is movable. Due to its shape it is an infinitely adjustable device for precession abdominal area workouts. This device can be moved in a full range of lower to upper back location.

The present invention allows muscle isolation. Due to its shape, it allows the isolation of a narrow range of muscles for very effective and very precise workout.

The present invention allows body rotation and is infinitely adjustable. It allows for any angle of body rotation, from lying all the way on one's back to lying all the way on one's side. In this manner, the present invention allows different areas of muscles to be exercised. It allows for any angle of upper to lower body twist at any angle between legs sideways or flat on the ground and the user's body flat on the back.

The present invention allows the body to various reclining angles. It is infinitely adjustable. Due to its shape, this device allows for any angle of body lowering from all the way up to all the way on the floor. This makes it usable for people of any level of exercise experience, from novice and older or handicapped people and even body builders. It provides fitness and shape maintenance exercises to all.

The present invention allows adjustable load and is infinitely adjustable. Due to its shape, this device allows for any adjustment of abdominal muscle load, thus making exercises employing this device easier or more difficult. The load adjustment is performed by utilizing persons arm or legs that serve as counter-balances. Due to the fact that this device works as a fulcrum, arms stretched further towards the center of fulcrum and beyond. It makes exercises easier to perform. Arms stretched further from the fulcrum and beyond a person's head, make the load on muscles greater. In this manner different levels of ability are accommodated. The same is done during leg lift. Even more load weights can be used, for example, handheld dumbbells may be sued when doing body lifts and leg weights may be used when doing leg lifts. This feature allows a person using this device to do a pre-set amount of repetitions as is done with other physical exercises. For example, a regular ab crunch does not allow this because in its common form there is no way to adjust the exercise load.

The present invention is adjustable for handicap levels. Due to its shape and described exercise variation, this device is a great tool for back recovery and for eliminating back problem areas. For example, people with lower back problems can avoid any lower back strain by moving the device up their back.

In summary, the present invention allows a person to work out any inch of ab/oblique muscles and any angle, with any body rotation or any upper-to-lower body twist, at any body recline position with any desired load on ab/oblique muscles.

This size, narrow enough, and this shape, with crowned top surface, and the resilience of the present invention can be used to stretch a person's abdominal, oblique, back muscles thus allowing for a wider active range of muscles being targeted.

This size, narrow, and this shape, crowned, with its resilience can be used as a fulcrum for body or leg thus allowing for more precise exercising different areas of muscles.

This size, narrow, and this shape, crowned device, along with its resilience can be moved to a wide range of stomach positions under a person's back, side, stomach, thus allowing precision targeting of any area being exercised.

By moving the support/fulcrum point in a wide range, different area of muscles can be more effectively involved, thus allowing for higher degree of muscle isolation and a more effective workout.

This size, narrow, and this shape, crowned, along with its resilience, defines a device which allows for any degree of body rotation, from horizontal location all the way on the back to perpendicular location on the side allowing for different areas of abdominal and oblique muscles to be isolated and exercised.

This size, narrow, and this shape, crowned, along with its limited resilience allows for any degree of body-to-legs rotation thus allowing for different areas of abdominal and oblique muscles to be isolated and exercised.

This size, narrow enough, and this shape, with crowned top surface, along with its resilience allows for different degree loads to be applied to abdominal and oblique muscles thus allowing a very wide range of people to use it, from beginners and handicap people to bodybuilders.

The present invention is a pillow that is shaped and sized and resilient in such a manner that it can be placed under a person's body and serve as a support while a person reclines on it in a manner that the abdominal or oblique or back muscles get stretched over the object.

The pillow of the present invention is made of such material that it is hard enough to support a person's body and at the same time it is soft enough to be not too hard while supporting a person's body. The pillow is also as narrow as possible so it supports the body serving as a cushion. It securely supports a person's body but at the same time it can be moved along a person's back from the lower back position to the upper back position so as to exercise different areas of a person's muscles.

This is an invention which serves as an elevated support over which a person's muscles can be stretched. It is also a pillow which serves as a fulcrum over which a person's body or legs can be lifted.

The present invention stretches abdominal/oblique/back muscles. It allows a person to contract only the muscles located over this object thus involving mostly these areas of muscles. In other words the pillow isolates a specific narrow area of muscles for a more effective workout.

The present invention allows a person to lift either leg or the body while using the pillow as a fulcrum. It allows for a person's body over it while on the person's back or on the person's side. It allows a person's body to be positioned over it with a variety of angles of legs to body twist. It can be moved under a person's back from the lower back position to the upper back position. It allows for a variety of recline angles. It allows for exercises to be done either from slightly reclined position to a more reclined position. The more reclined position is for people with weak muscles. The slightly reclined position, substantially even with the floor, is for more trained people. It also allows for exercises to be done in the opposite direction, from the floor to different angles of reclining position. It allows for muscle load to be adjusted by using different positions of a person's arms or legs and also by using weights.

The present invention makes many exercises more effective, safer, and more available to different handicap groups. The invention allows unique exercises.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of exercising with a support system having a fulcrum about which a user's body may pivot while bending between a lowered orientation and a raised orientation, the method comprising the steps of:

providing a one piece pillow, the pillow having a rectangular lower surface with a linear forward edge and a parallel rearward edge, the forward edge and rearward edge being spaced by a length of 9 inches, plus or minus 10 percent, the lower surface having lateral side edges perpendicular to and coupling the forward and rearward edges, the side edges being spaced by a width of 10 to 16 inches, plus or minus 10 percent, the lower surface being positionable horizontally upon a recipient surface during use;

the pillow having an arcuate upper surface, the upper surface having a forward section formed with a continuous radius of curvature of 5 inches, plus or minus 10 percent, over the majority of its extent, the upper surface having a rearward section formed with a continuous radius of curvature of 15 inches, plus or minus 10 percent, over the majority of its extent, the pillow having a height between the upper and lower surfaces with the maximum height being 2.5 inches, plus or minus 10 percent, the upper surface having a high point located closer to the forward edge than the rearward edge with between 40 and 45 percent of the length of the pillow being forward of the high point and with between 55 and 60 percent of the length of the pillow being rearward of the high point;

the pillow having similarly configured parallel side surfaces, each side surface being planar and having a linear lower edge co-extensive with one of the side edges of the lower surface, each side surface having a curved upper edge;

the pillow being fabricated of closed cell ethylene vinyl acetate foam and having a limited resilience whereby the high point is depressed by between 15 and 20 percent of its height when a user weighing between 120 and 180 pounds lies upon the pillow; and supporting a user on the pillow;

the pillow being adapted to support the user with the high point beneath one side of the user; and using the pillow as a fulcrum while lifting one portion of the user's body.

* * * * *